United States Patent [19]

Meier et al.

[11] Patent Number: 4,522,183

[45] Date of Patent: Jun. 11, 1985

[54] METHOD FOR CONVERTING A RETROGRADE SUBSTANCE TO THE GASEOUS STATE

[75] Inventors: Gerd E. A. Meier, Goettingen, Fed. Rep. of Germany; Philip A. Thompson, Arlington, Va.

[73] Assignee: Max-Planck-Gesellschaft zur Förderung der Wissenschaften e.V., Göttingen, Fed. Rep. of Germany

[21] Appl. No.: 548,011

[22] Filed: Nov. 1, 1983

Related U.S. Application Data

[63] Continuation of Ser. No. 984, Jan. 4, 1979, abandoned.

[30] Foreign Application Priority Data

Jan. 10, 1978 [DE] Fed. Rep. of Germany ..... 2800894

[51] Int. Cl.[3] ..... F02M 31/00

[52] U.S. Cl. ..... 123/558; 123/557

[58] Field of Search ..... 123/549, 294, 557, 558; 48/180

[56] References Cited

U.S. PATENT DOCUMENTS 2,744,507 5/1956 Huber ..... 123/294
3,762,378 10/1973 Betonlé et al. ..... 123/549
4,083,340 4/1978 Furr ..... 123/122 E

FOREIGN PATENT DOCUMENTS 1931539 12/1970 Fed. Rep. of Germany .
324334 9/1957 Switzerland .
642431 9/1950 United Kingdom .

OTHER PUBLICATIONS

Thompson et al., "On the Possibility of Complete Condensation Shock Waves in Retrograde Fluids," *J. Fluid Mech.*, (1975), vol. 70, part 4, pp. 639–649.

*Primary Examiner*—Ronald H. Lazarus
*Attorney, Agent, or Firm*—Spencer & Frank

[57] ABSTRACT

A method for converting a retrograde substance from a liquid to a gaseous state comprising bringing the substance to a defined initial state of pressure and volume, and relaxing to a defined final state. The defined states correspond to regions on the pressure-volume diagram of the substance, the initial state lying to the lower volume side of a boundary defined by the branch of the critical isentrope lying to the greater pressure side of the critical point, and by the stability limit of the substance. The final state lies to the greater volume side of this boundary.

15 Claims, 6 Drawing Figures

P
V
$P_o$
$P_a$
1
2
3
4
Z
$A_4$ $A_3$ $A_2$
$A_Z$
$A_1$
LIQUID
CRITICAL POINT
STABILITY LIMIT
$B_Z$
$B_2$
$B_3$
$C_Z$
$C_2$
$E_4$
$E_3$
$E_2$
$E_Z$
S

METHOD FOR CONVERTING A RETROGRADE SUBSTANCE TO THE GASEOUS STATE

This application is a continuation, of application Ser. No. 984, filed Jan. 4th, 1979 now abandoned.

BACKGROUND OF THE INVENTION

The present invention relates to a method for the gasification of retrograde substances.

A retrograde substance is understood to mean a substance which has a characteristic specific heat $\hat{c}_v > 11.2$. A large portion of the organic liquids presently used in the art are retrograde, particularly the conventional carburetor and Diesel fuels as well as kerosene.

For many applications, it is desired to realize as complete a conversion of such liquids to the gaseous state as possible. This is of particular significance for fuels used in internal-combustion engines since complete vaporization is a prerequisite for complete combustion and low pollutant content in the exhaust gases.

OBJECT OF THE INVENTION

It is the object of the present invention to provide a method with which retrograde substances can be converted to gases in a novel manner and, in the preferred embodiments of the method, completely.

This is accomplished according to the invention by a method in which a retrograde substance is brought to a defined initial state of pressure and volume, and is relaxed to a defined final state. These defined states correspond to regions on the pressure-volume diagram of the substance, the initial state lying to the lower volume side of a boundary defined by the branch of the critical isentrope lying to the greater pressure side of the critical point, and by the stability limit of the substance. The final state lies to the greater volume side of this boundary.

The method is very simple to perform since practically only one heating and relaxation step (pressure reduction) need be performed on the retrograde substance. In the method according to the invention, the retrograde substance is, of necessity, converted from the liquid state to the pure gaseous state.

The relaxation can occur essentially isentropically or polytropically (e.g. with the addition of heat). For a polytropic change of state with the addition of heat a lesser increase in temperature is required than for purely isentropic relaxation.

The theoretical principles and embodiments of the invention will be explained in detail below with reference to the drawings.

BRIEF DESCRIPTION OF THE DRAWINGS

It is shown in.

DETAILED DESCRIPTION OF THE INVENTION

Figure 1:
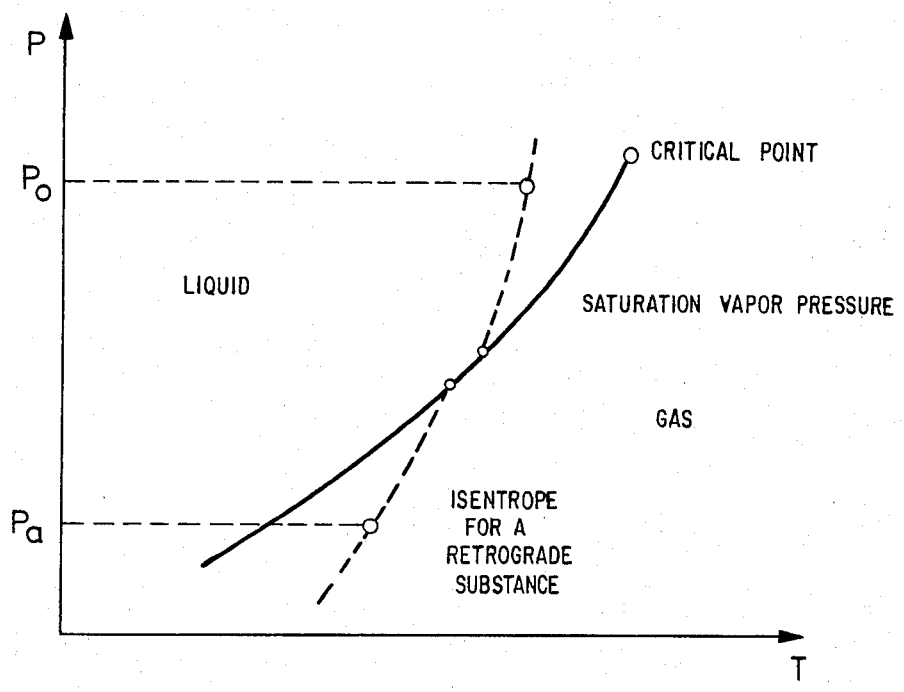
FIG. 1, a pressure-temperature diagram (PT diagram) for a retrograde liquid.

The PT diagram of FIG. 1 shows the saturation vapor pressure (solidly drawn curve) and an isentrope (dashed curve) for a retrograde substance. The isentrope shown is steeper than the vapor pressure curve so that the respective substance can be converted, for example from an initial pressure $P_O$ to a final pressure $P_a$, from the liquid state to the pure gaseous state by isentropic expansion.

This property of retrograde substances is utilized in the method according to the invention. In order to convert a retrograde substance to the gaseous state, the substance is, briefly stated, brought to a certain temperature and then relaxed to a certain final pressure, the temperature being selected so that the final point of the change in state effected by the relaxation lies in the gaseous range.

The term "change of state" is here to be understood in a thermodynamic sense and indicates a transition of the substance from an initial state which is determined by an initial temperature, an initial pressure and an initial volume, to a certain final state which is determined by a certain final pressure, a certain final volume and a certain final temperature.

Figure 2:
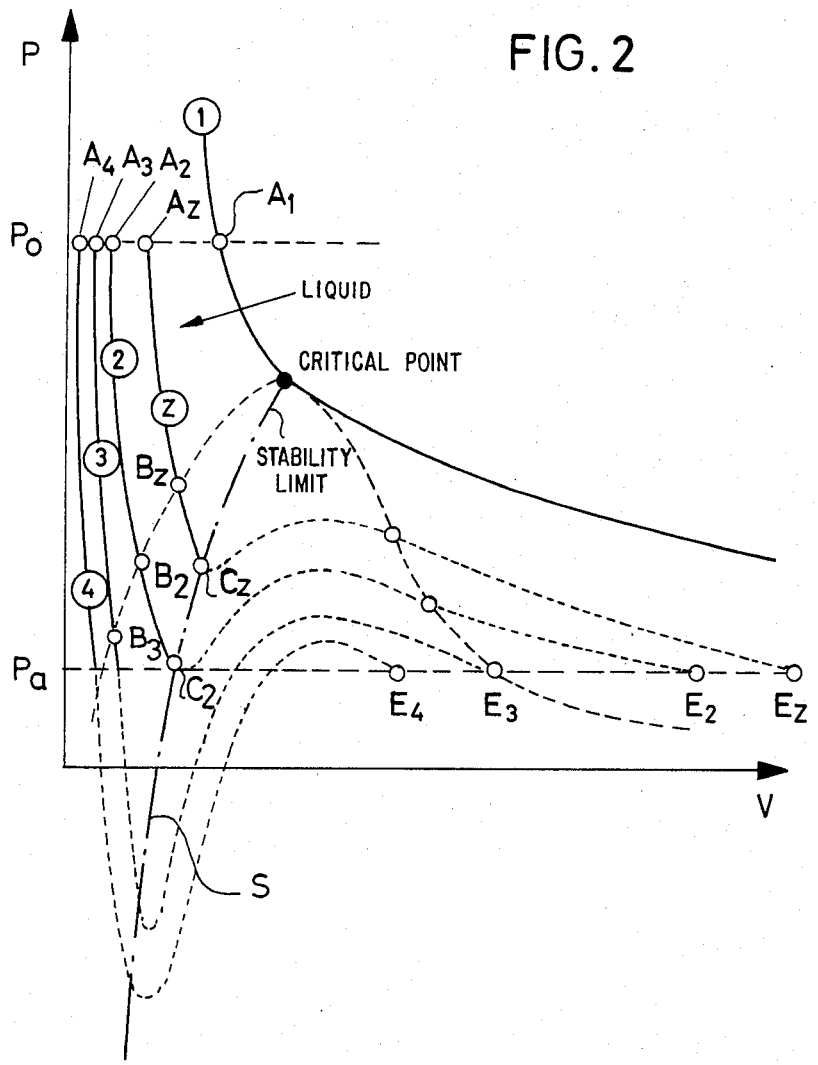
FIG. 2, a pressure-volume diagram (PV diagram) for a retrograde liquid; this diagram will be used to explain certain embodiments of the invention.

FIG. 2 shows examples of changes in state of a retrograde substance by isentropic expansion. The curve marked (1) is the critical isentrope passing through the critical point. Further isentropes are shown at (2), (3), (4) and (z). The dashed curve is the phase interface which separates, below the critical point, the regions where there exists pure liquid, liquid-vapor (mixed region), and gas. Finally, a dot-dash line shows the so-called stability limit which passes through the critical point and approximately through the minima of the isentropes (in practice the stability limit seems to lie somewhat to the left of the minimum as shown in FIG. 2).

Let it be assumed that the retrograde substance is to be relaxed from an initial pressure $P_O$ to a final pressure $P_a$ and thus converted to the gaseous state. If the substance is heated before relaxation to a temperature corresponding to state $A_z$ and then relaxed, there will initially occur a normal vaporization process at point $B_z$ when the vapor pressure curve is exceeded. Upon reaching point $C_z$, the stability limit is exceeded, the liquid state is no longer stable and an abrupt transition to the gaseous state takes place. Finally, the substance takes on the final state at point $E_z$ corresponding to the pressure $P_a$.

The isentrope (2) reaches the stability limit at point $C_2$ at the final pressure $P_a$ of relaxation. Thus, in this embodiment an abrupt, explosion-like transition to the gaseous state occurs for all initial states between $A_1$ and $A_2$.

For isentrope (3) the final state $E_3$ lies at the limit of saturated vapor. This isentrope thus corresponds to a change in state in which the retrograde substance represented by the diagram of FIG. 2 is just yet converted completely to the gaseous state during relaxation from $P_O$ to $P_a$. Since, however, the isentrope (3) has no point of intersection with the stability limit above the final pressure $P_a$, no explosion-like atomization and conversion to the gaseous state occur.

All isentropes in the region between the two limit isentropes (1) and (3) thus have the characteristic that liquid states ($P_O$, $T_O$) which are isentropically relaxed up to pressure $P_a$ are associated with a complete conversion of the retrograde substance to the gaseous state. For isentropes between the limit isentropes (1) and (2), the stability limit S is reached at a pressure which lies above $P_a$ so that the transition to the gaseous state is practically of the type of an explosion.

A reasonable limit for heating the liquid is given by the critical isentrope (1) since here the limiting liquid states are assumed to exist slightly below the critical point. Initial points between $A_1$ and $A_2$ are particularly advantageous since here the minimum of the isentropes or of the stability limit S, respectively, are reached and an instability point is exceeded during the isentropic relaxation of the liquid. The liquid is then of necessity converted to gas and cannot continue to exist as a "supersaturated liquid" in a tensioned or undercooled state.

For polytropic changes in state, i.e. generally changes in state with the addition of heat, the curves representing the changes in state are even flatter. The temperature increases required for evaporation or explosion-like atomization to reach the desired end state can then be selected even lower.

The isentrope (4) in FIG. 2 leads to a nonspontaneous partial vaporization which, however, is actuated by disturbances.

In practice, the actually assumed final states do not lie precisely on the corresponding isentrope as shown in an idealized manner through points $E_z$. . . $E_4$, because in the dynamic processes of vaporization there always occurs a certain increase in entropy. But such increase in entropy is an advantage for the vaporization process.

Figure 3:
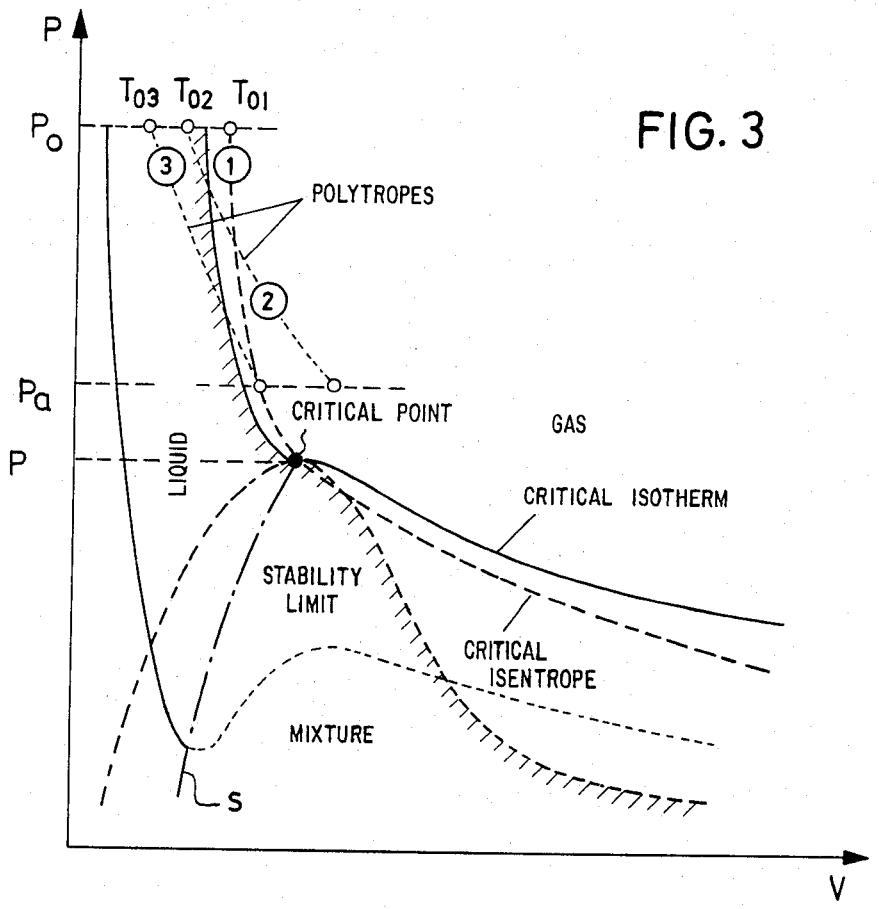
FIG. 3, a further PV diagram to which reference will be made in the explanation of other embodiments of the invention.

If the final pressure $P_a$ of relaxation lies above the critical pressure of the substance in question, vaporization can be assured only in that the substance is heated to a temperature which lies above the critical temperature at rest. The relationships are shown in the PV diagram of FIG. 3.

Isentropic expansion along the critical isentrope or adiabat with the initial state $P_O$, $T_{O1}$ always leads to a gaseous final state even with a supercritical final pressure $P_a$. The same applies for a polytropic change in state with the addition of heat which begins with a liquid state $P_O$, $T_{O2}$, intersects the critical isotherms and the critical isentrope and ends in the gaseous range at a final pressure $P_a$. A reasonable initial temperature $T_{O3}$ is given for every polytropic change in state with the addition of heat in that the final point of the polytropic change in state is selected to be a point on the critical isentrope which then will definitely lie in the vapor region because the respective polytrope always intersects the flatter critical isotherm defining the liquid region. For substances of a nonuniform composition, that is mixtures, it is often sufficient if for the substance component having the lowest critical temperature $T_{nk}$ the initial temperature $T_O$ is greater than $T_{nk}$. Then the mixture can also be vaporized at high final pressures $P_a$.

In the Table below several examples are given for changes of state of $C_8H_{18}$ and $C_{14}H_{30}$, in which a transition from the saturated liquid state to the saturated gaseous state takes place by isentropic expansion according to the method of the invention.

TABLE

| | Initial State (liquid) | | Final State (gas) | | FIG. 2 |
|---|---|---|---|---|---|
| Substance | $T_0$ (°C.) | $P_0$ (bar) | $T_a$ (°C.) | $P_a$ | Case: |
| $C_8H_{18}$ | 226 | 7.8 | 80 | 0.1 | B3/E3 |
| (octane) | 252 | 11.9 | 137 | 1.0 | B3/E3 |
| | 270 | 16.0 | 163 | 1.0 | Bz/Ez |
| | 270 | 16.0 | 178 | 3.0 | Bz/Cz |
| $C_{14}H_{30}$ | 109 | 0.5 | 85 | 0.004 | B3/E3 |
| | 322 | 4.3 | 245 | 1.0 | B3/E3 |

The principle of atomization or vaporization of retrograde substances by heating at high pressure in the liquid phase and subsequent adiabatic or polytropic relaxation can be used in industry in many ways. The final pressure $P_a$ may correspond, for example, to the pressure in the chambers of an internal combustion engine or to the atmospheric pressure in a combustion chamber for a firing system.

For Otto or Diesel engines with direct fuel injection the fuel is injected into the cylinder during the compression stroke. Imperfect atomization of the fuel and incomplete mixing with the combustion air, features which are absolutely necessary for good and complete burning of the cylinder charge, produce considerable problems in practice with respect to combustion. Since the conventional fuels are retrograde substances, the present method can be used to great advantage for the conversion of the fuel to the gaseous state. For this purpose the fuel is heated, before being injected into the cylinder antechamber, according to the teaching given above. It should be noted in this connection that preheating of fuels, particularly of heavy oil is known (see, for example, German Pat. Nos. 841,973 and 1,103,079).

Figure 4:
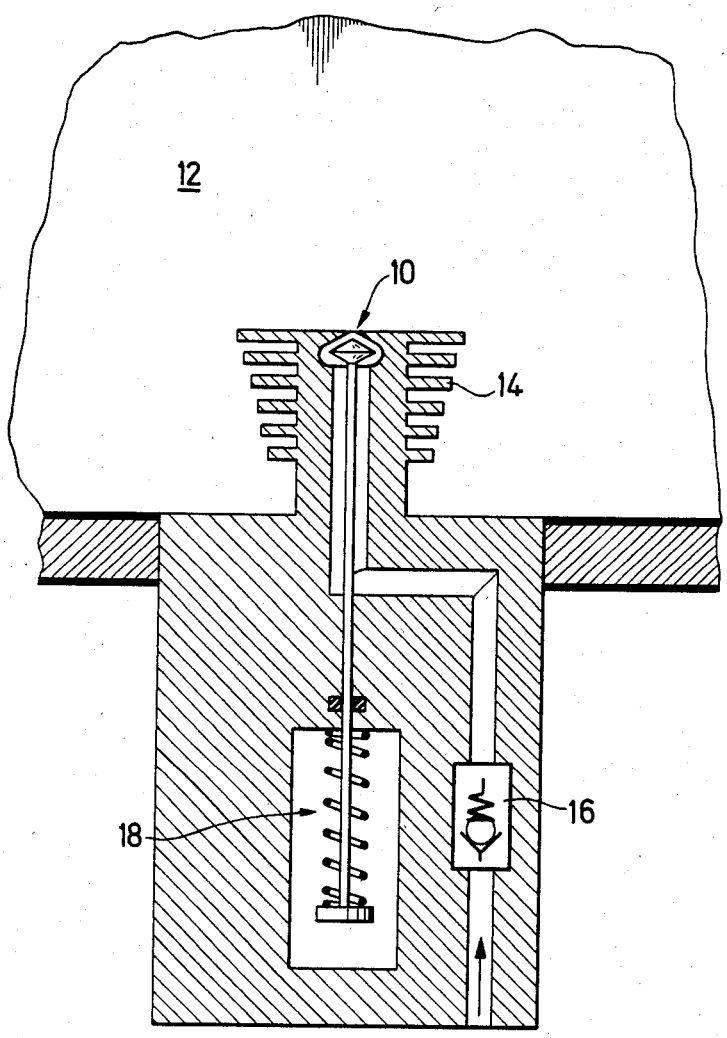
FIG. 4, a schematic illustration of an apparatus for practicing the method according to the invention.

As shown in FIG. 4, the preheating of the fuel before injection can be effected, for example, by means of a specially designed injection nozzle. The injection nozzle 10 has a neck 14 extending into the combustion chamber 12 and is possibly provided with ribs. It is designed in such a manner that in the normal state of operation just enough heat is absorbed and transmitted to the fuel flowing through, that the latter takes on the desired initial state ($A_z$, FIG. 2) which effects the desired atomization or carburetion. It may here be advisable to provide a check valve 16 in the fuel line leading to the injection nozzle so that the increase in pressure as a result of the increase in temperature cannot have a reactive effect on the intake line system. The injection nozzle is provided with a control device 18 which is shown only schematically and may be of conventional design.

During constant pressure combustion, as it takes place in all firing systems operated with oil and emulsified fatty fuels, the method according to the invention can be used with success for the conversion of the retrograde liquid fuel components to the vaporous or gaseous state. Due to the fine dispersion of the fuel, the creation of carbon particles can here be prevented by droplet distillation, and intensive mixing of the fuel with the air can be accomplished by means of the turbulence of the gas streams. Heating of the fuel in the intake lines is here advisably effected by preheated air which can simultaneously be used for premixing. An apparatus operating according to this principle is shown in FIGS. 5 and 6.

Figure 5:
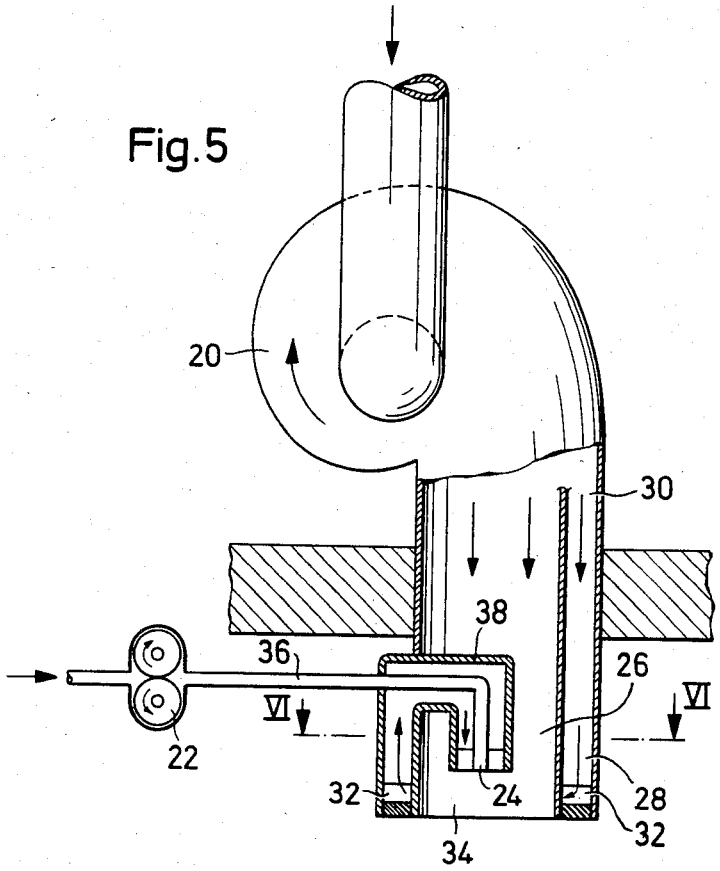
FIG. 5, a schematic illustration of a further apparatus for practicing the method according to the invention.
Figure 6:
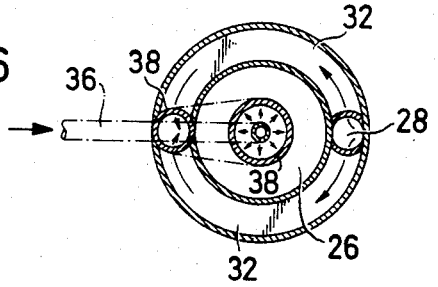
FIG. 6, a sectional view taken in the plane VI—VI of FIG. 5.

The apparatus according to FIGS. 5 and 6 is basically a conventional blower-driven combustor including an air blower 20, a fuel supply pump 22, a fuel nozzle 24 and an air channel 26 surrounding the fuel nozzle in the form of a ring and being connected with the discharge of the blower 20.

In addition to this arrangement which corresponds to the conventional combustor, a preheating air channel 28 is provided. The preheating air channel 28 has a tubular inlet 30 into which enters part of the air conveyed by the blower 20. This air then flows through an annular chamber 32 arranged at the lower end of the blower air channel 34, is heated there and then flows through an approximately U-shaped pipe 38 enclosing the end of the fuel line 36 to be discharged parallel to nozzle 24. The branched-off air is heated in annular chamber 32, then transfers the required heat to the fuel in line 36 and leaves at nozzle 24 where it is mixed with the fuel mist.

The part of the fuel line 36 in pipe 38 and the outer wall of chamber 32 may be provided with ribs to increase surface area and thus improve heat transfer. This measure which is conventional for heat exchangers is not shown in FIGS. 5 and 6 so as not to make these figures, which are intended to show only the principle of a device for practicing the method according to the present invention, unnecessarily cluttered.

The method according to the invention does not require any excessively high temperatures and pressures as they are used in certain prior art methods (see, for example, Swiss Pat. No. 324,334) without the knowledge of the spontaneous vaporization effect occurring in retrograde substances.

In the present method, the critical temperature and/or the critical pressure are preferably exceeded only by about 10% or 20%; of course, the critical temperature and/or the critical pressure can also be exceeded by 50% or 100%, although for reasons of increased expenditures, this would not be expedient.

A preferred field of use for the invention is the vaporization of retrograde fuels, particularly light heating oil and most of all fuels such as kerosene and gasoline for internal-combustion engines. The temperatures and pressures from which the expansion is effected should in this case lie substantially below 250° C. or 80 bar, respectively.

What is claimed is:

1. Method for abruptly converting a retrograde substance having a characteristic specific heat $\hat{c}_v > 11.2$ from a liquid to a gaseous state, comprising reducing the pressure on the liquid polytropically with the addition of heat from an initial state of elevated pressure of 0.5 to 16 bar and corresponding to a point in the region of a pressure-volume diagram of the substance which lies to the lower volume side of a boundary formed by the branch of the critical isentrope of the substance extending from the critical point to higher pressures and by the stability limit of the substance, to a final state which corresponds to a point on the greater volume side of said boundary, wherein the stability limit defines the locus of the points on isentropes corresponding to a plurality of initial states, the exceeding of which in the direction toward greater volumes causes the liquid state of the retrograde substance to become unstable, said locus of points passing through the critical point and intersecting each isentrope approximately at the point of minimum pressure for each isentrope.

2. Method according to claim 1 wherein the final pressure lies above the critical pressure, and wherein the point corresponding to the initial state is selected so that it lies essentially on the critical isentrope.

3. Method according to claim 3, wherein the substance is heated to a temperature above the critical temperature before it is relaxed.

4. Method according to claim 3 comprising converting a mixture of retrograde substances from the liquid to the gaseous state, by heating the mixture, before relaxation, to a temperature which lies above the critical temperature of the substance of the mixture of substances having the lowest critical temperature.

5. Method according to one of claims 1 through 4, which is used for the vaporization of a retrograde fuel.

6. Method according to claim 5, wherein said retrograde fuel is vaporized in an internal combustion engine.

7. Method according to claim 1 wherein the pressure to which the liquid is subjected in said initial state does not exceed the critical pressure of the liquid by more than 10% to 20%.

8. Method according to claim 1 wherein the temperature to which the liquid is subjected in said initial state does not exceed the critical temperature of the liquid by more than 10% to 20%.

9. Method according to claim 1 wherein the temperature to which the liquid is subjected to in the initial state is less than 250° C.

10. Method for abruptly converting a retrograde substance having a characteristic specific heat $\hat{c}_v > 11.2$ from a liquid to a gaseous state, comprising reducing the pressure on the liquid polytropically with the addition of heat from an initial state in which the temperature and pressure do not exceed the critical temperature and critical pressure by more than 20%, corresponding to a point in the region of a pressure-volume diagram of the substance which lies to the lower volume side of a boundary formed by the branch of the critical isentrope of the substance extending from the critical point to higher pressures and by the stability limit of the substance, to a final state which corresponds to a point on the greater volume side of said boundary, wherein the stability limit defines the locus of the points on isentropes corresponding to a plurality of initial states, the exceeding of which in the direction toward greater volumes causes the liquid state of the retrograde substance to become unstable, said locus of points passing through the critical point and intersecting each isentrope approximately at the point of minimum pressure for each isentrope.

11. Method for abruptly converting a retrograde substance having a characteristic specific heat $\hat{c}_v > 11.2$ from a liquid to a gaseous state as recited in claim 10, comprising reducing the pressure on the liquid polytropically with the addition of heat from an initial state in which the temperature of the liquid is below its critical temperature and the pressure is between 0.5 and 16 bar.

12. Method as recited in claim 11, wherein the initial temperature is between 109° C. and 322° C.

13. Method as recited in claim 12, wherein the critical temperature is less than 250° C.

14. Method for abruptly converting a retrograde substance having a characteristic specific heat $\hat{c}_v > 11.2$ from a liquid to a gaseous state, comprising reducing the pressure on the liquid without the addition of heat from an initial state of elevated pressure of 0.5 to 16 bar and corresponding to a point in the region of a pressure-volume diagram of the substance which lies to the lower volume side of a boundary formed by the branch of the critical isentrope of the substance extending from the critical point to higher pressures and by the stability limit of the substance, to a final state which corresponds to a point on the greater volume side of said boundary, wherein the stability limit defines the locus of the points on isentropes corresponding to a plurality of initial states, the exceeding of which in the direction toward greater volumes causes the liquid state of the retrograde substance to become unstable, said locus of points passing through the critical point and intersecting each isentrope approximately at the point of minimum pressure for each isentrope.

15. Method for abruptly converting a retrograde substance having a characteristic specific heat $\hat{c}_v > 11.2$ from a liquid to a gaseous state as recited in claim 14, comprising reducing the pressure on the liquid without the addition of heat from an initial state in which the temperature of the liquid is below its critical temperature and the pressure is between 0.5 and 16 bar.

* * * * *